United States Patent [19]

Dickey

[11] 4,020,576

[45] May 3, 1977

[54] CARRIER FOR THE PRESENTATION OF PAGES OF CONVENTIONAL READING MATERIAL

[75] Inventor: Herbert C. Dickey, North Reading, Mass.

[73] Assignee: The Ealing Corporation, South Natick, Mass.

[22] Filed: May 28, 1975

[21] Appl. No.: 581,588

[52] U.S. Cl. ..... 40/86 R

[51] Int. Cl.[2] ..... G09F 11/29

[58] Field of Search ..... 40/86, 159, 31, 32, 40/96

[56] References Cited

UNITED STATES PATENTS

| | | | |
|---|---|---|---|
| 2,549,452 | 4/1951 | Green | 40/86 |
| 3,120,066 | 2/1964 | Reeves | 40/31 X |
| 3,482,329 | 12/1969 | Le Marr | 35/9 A |
| 3,510,973 | 5/1970 | Mazzocco, Sr. | 40/31 |
| 3,780,458 | 12/1973 | Jacoby et al. | 40/31 |

FOREIGN PATENTS OR APPLICATIONS

| | | | |
|---|---|---|---|
| 2,115,414 | 10/1972 | Germany | 40/86 |

*Primary Examiner*—John F. Pitrelli
*Attorney, Agent, or Firm*—Anthony H. Handal

[57] ABSTRACT

A carrier is disclosed which is especially useful for the display of reading material in conventional printed form by an automatic reading apparatus of the type which employs a reel to reel cassette. The carrier comprises a scroll which is wound on one of the reels and automatically advanced from that reel along a path which permits the scroll to be viewed and read by a user. The scroll structure comprises a backing sheet to which a transparent facing sheet is transversely laminated at spaced positions along the length of the scroll. The portions of the scroll between the spaced laminations thus form pockets into which reading material in conventional page form is inserted for display by the automatic reading apparatus. At least one end of the laminations extend toward but does not reach the edge of the scroll, thereby leaving a continuous unlaminated margin on the scroll. An insertion member on the cassette is disposed between the facing and backing sheets in the unlaminated margin to serve as a guide for the insertion of pages into the scroll.

2 Claims, 5 Drawing Figures

CARRIER FOR THE PRESENTATION OF PAGES OF CONVENTIONAL READING MATERIAL

BACKGROUND OF THE INVENTION

The present invention relates to carriers which are particularly well suited for use in conjunction with an automatic reading apparatus. More particularly the invention is concerned with a cassette and scroll structure which permits the use of conventional reading material in an automatic reading apparatus.

By way of example, the inventive scroll structure would be particularly useful in conjunction with a reading machine of the type disclosed in the U.S. patent application Ser. No. 356,412 of Paul Grindle, filed May 2, 1973, assigned to the same assignee as the instant application, and entitled Apparatus and Method for Presentation of Reading Materials, now U.S. Pat. No. 3,882,620. The system disclosed in that application uses a scroll having the desired material printed on it. Naturally, reading material is not commonly available in this form and any desired item of reading matter must therefore be specially prepared for use in the machine. This process, compared to conventional publishing techniques, is relatively expensive, especially if only a relatively small number of copies of a given item of reading material are to be printed.

SUMMARY OF THE INVENTION

The carrier structure of the instant invention is particularly advantageous insofar as it permits the use of conventional printed pages in an automatic reading machine and allows semi-automated loading of the pages. The carrier comprises a scroll which comprises a continuous backing sheet to which a continuous transparent facing sheet is selectively laminated to form a series of printed page receiving pockets. Laminated seams are periodically disposed along the length of the scroll and extend transversely across at least a central portion of the facing and backing sheets. At least one end of the seams extends toward but does not reach the edge of the laminated sheets.

This results in leaving approximately a half inch of one edge portion of the scroll unlaminated. This permits the insertion of a page insertion member on the cassette between the backing and facing sheet of the scroll during advancement of the scroll through the reading machine. If desired, using this feature, the scroll may be loaded by advancing the empty scroll through the machine automatically and inserting the pages into the machine through the guiding channel of the page insertion member. A reading machine useful with a cassette including this page insertion member is described in my co-pending U.S. patent application Ser. No. 581,589, now U.S. Pat. No. 3,983,651 entitled Apparatus for the Presentation of Reading Materials, filed concurrently and assigned to the same assignee as the instant application, the disclosure of which is incorporated by reference. The scroll is also desireably provided with indexing means for indicating the position of the various pockets on the scroll.

In accordance with the present invention, when it is desired to view conventional reading material, it is merely necessary to obtain two copies of the material, if it is printed on both sides, because only one side of each page will be visible through the facing. Thus, if one desired to put a book into the scroll for viewing on an automatic reading machine, one would buy two copies of the book, separate the two copies into single sheets and insert successive pages of the book into the pockets, oriented in such a manner that the successive pages of the book are visible through the transparent facing sheet of the scroll. This loaded scroll is then rolled onto a spool and put in the cassette for insertion into the reading machine.

BRIEF DESCRIPTION OF THE DRAWINGS

The nature, advantages, and various features of the invention will appear more fully upon the consideration of the illustrative embodiments now to be described in detail in connection with the accompanying drawing in which.

DETAILED DESCRIPTION OF THE PREFERRED EMBODIMENT

Figure 1:
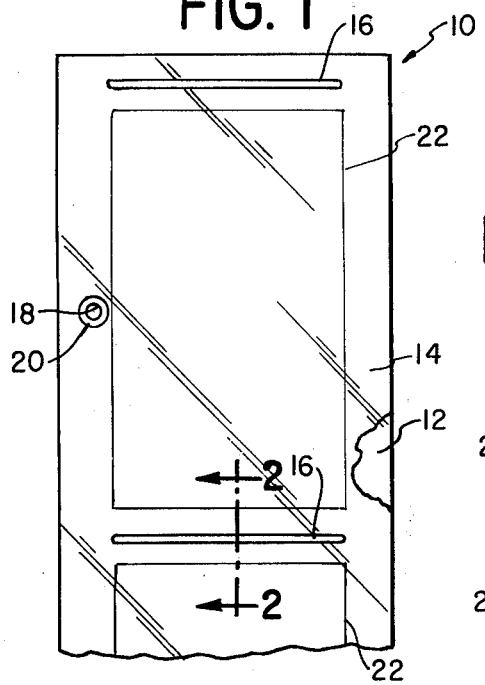
FIG. 1, is a plan view of a carrier constructed in accordance with the present invention, containing pages of conventional reading material.
Figure 2:
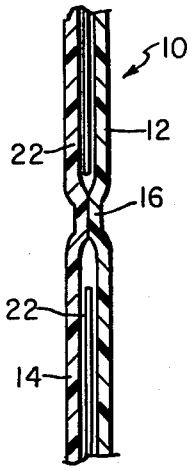
FIG. 2, is a cross-section along line 2—2 of FIG. 1.

Referring to FIGS. 1 and 2, the scroll 10 of the present invention comprises a backing sheet 12 and a facing sheet 14. Backing sheet 12 may be made of any desired material such as paper or polyvinyl chloride film. The facing sheet 14 may also be made from any one of a number of transparent materials such as mylar. In the preferred embodiment, the backing 12, as well as the facing sheet 14, are both made of polished vinyl film which has a thickness of approximately 3–4 mils.

Pockets for carrying pages of reading material are formed between transverse laminated seams 16 which are spaced at periodic intervals along the length of scroll 10.

The scroll is also provided with an index mark for indicating to the automatic reading apparatus the position of the pocket. In the preferred embodiment, this index mark takes the form of a punched hole 18 whose presence is detected in the reader by the spring biased actuating arm of an electrical switch. Alternatively, any other type of index mark may be used. For example, a printed mark detected by suitable photo-sensitive circuitry may be used in place of hole 18. It may also be desired to laminate the facing sheet to the backing sheet in the area 20 surrounding hole 18.

Figure 3:
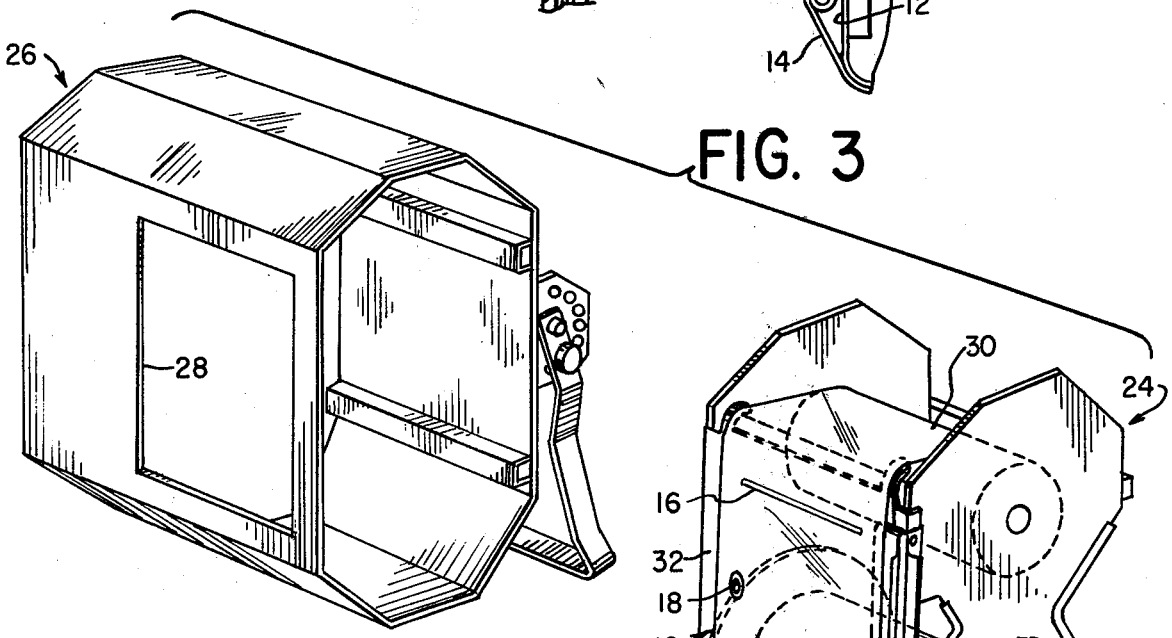
FIG. 3, is an exploded view of a reading apparatus and a cassette and scroll carrier constructed in accordance with the present invention.

In use, each page 22 of the desired reading material is contained within pockets formed between the laminated seams. The loaded scroll 10 is contained within a cassette 24 (FIG. 3) which is adapted for insertion into a reading apparatus 26. The reading apparatus 26 includes an aperture 28 on its front through which the scroll is read. The scroll is initially wound on a reel 30 in cassette 24 and extends over and around the facing portion 32 of the cassette and onto a take-up reel 34 in the cassette. Thus, when the cassette is placed inside reading apparatus 26, the pages of reading material 22 are visable through aperture 28.

Figure 4:
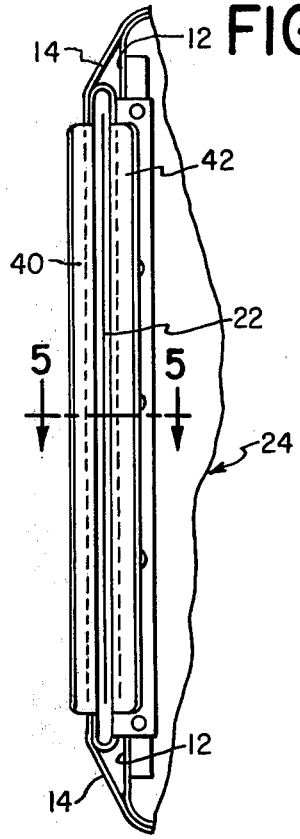
FIG. 4, is a detail view of a portion of a cassette carrying a scroll, showing the page insertion member.
Figure 5:
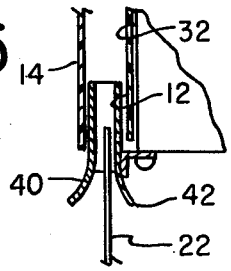
FIG. 5, is a view along lines 5—5 of FIG. 4.

When it is desired to put reading material into scroll 10, the particular construction of the inventive scroll and cassette allows this to be done semi-automatically. Referring in particular to FIGS. 4 and 5, an empty scroll rolled on reel 34 may be inserted into cassette 24. This scroll is then passed under guides 36 and over the facing portion 32 of the cassette. Insofar as scroll 10 contains a peripheral unlaminated area 38 which extends along the length of one side of the scroll, the scroll may be passed over facing portion 32 and around spout-shaped loading guide members 40 and 42. Guide member 40 is thus located adjacent the facing sheet 14 while guide member 42 is located adjacent the backing sheet 12. Thus, guide members 40 and 42 are disposed between the facing and backing and may be used to guide the entry of pages into the pockets formed between seams 16 on the scroll. Furthermore, this may be done semi-automatically by simply setting the reading machine to advance the empty scroll at a relatively fast rate, periodically stopping at each page for a period of time normally meant for the purpose of reading the page.

While an illustrative embodiment of the present invention has been disclosed it is of course understood that various modifications of the scroll, such as changes in the size and dimensions of its various parts, will be obvious to those of ordinary skill in the art. For example, the spout-shaped insertion member may be replaced by a single element which serves merely to separate the facing and backing sheet of the scroll. These changes are contemplated to be within the spirit and scope of the invention, which is limited and defined only by the appended claims.

I claim:

1. A carrier adapted for receiving a scroll comprising a facing sheet and a backing sheet and a plurality of pockets disposed along its length and an unlaminated portion extending along at least on edge of said scroll, said scroll being adapted to be wound around a feed spool, said carrier comprising:

a. means for supporting a feed spool in said carrier and a take-up spool for taking up said scroll as it is unwound from said feed spool;

b. a facing portion disposed on said support means and positioned, configured and dimensioned to underlie said scroll as said scroll passes from said feed-spool to said take-up spool; and c. means for guiding the insertion of pages into the scroll, said insertion means positioned adjacent said facing portion and positioned dimensioned and configured to be disposed over said backing sheet and between the unlaminated portion of said facing and backing sheets when said scroll is disposed over said facing portion.

2. A carrier comprising:

a. a scroll having a plurality of pockets disposed at periodic intervals along its length, said pockets adapted to carry and display pages of reading material and receive a page guiding member, said scroll comprising:

i. backing sheet having a length substantially longer than its width and having first and second peripheral edges disposed at opposite sides of its width; and ii. a transparent facing sheet having a length substantially longer than its width and having first and second peripheral edges disposed at opposite sides of its width, said facing sheet being disposed over said backing sheet and laminated to said backing sheet along seams disposed at periodic intervals along the length of said sheets, said seams being disposed transversely to the width of said facing and backing sheets and extending toward said first and second peripheral edges of said sheets, and at least one end of said seams extending toward but not reaching said second peripheral edge to provide an unlaminated peripheral portion for receiving the page guiding member;

b. means for supporting a feed spool dimensioned and configured to allow said scroll to be wound thereon and a take-up spool for taking up said scroll as it is unwound from said feed spool;

c. facing means disposed on said support means and positioned, configured and dimensioned to underlie said scroll as said scroll passes from said feed-spool to said take-up spool; and d. means for guiding the insertion of pages into the scroll, said insertion means positioned adjacent said facing means overlying said facing means, said insertion means dimensioned and configured to be disposed over said backing sheet and between said facing and backing sheets when said scroll is disposed over said facing means.

* * * * *